US006111358A

United States Patent [19]

Cardwell et al.

[11] Patent Number: 6,111,358

[45] Date of Patent: Aug. 29, 2000

[54] SYSTEM AND METHOD FOR RECOVERING POWER FROM A TRAVELING WAVE TUBE

[75] Inventors: Gilbert I. Cardwell, Palos Verdes Peninsula, Calif.; John A. Collins, Azalea, Oreg.; Thomas K. Phelps; Xiaoling Zhai, both of Torrance, Calif.

[73] Assignee: Hughes Electronics Corporation, El Segundo, Calif.

[21] Appl. No.: 09/127,518

[22] Filed: Jul. 31, 1998

[51] Int. Cl.[7] ..... H01J 25/34; H01J 23/027

[52] U.S. Cl. ..... 315/3.5; 315/5.38

[58] Field of Search ..... 315/5.38, 3.5, 315/39.3

[56] References Cited

U.S. PATENT DOCUMENTS 2,653,270 9/1953 Kompfner ..... 331/82 X
2,769,910 11/1956 Elings ..... 315/39.3 X
2,957,983 10/1960 George ..... 315/39.3 X
3,448,324 6/1969 Eggers et al. ..... 315/5.38 X
4,631,447 12/1986 Friedman et al. ..... 315/5.38 X
5,568,014 10/1996 Aoki et al. ..... 315/3.5

*Primary Examiner*—Benny T. Lee
*Attorney, Agent, or Firm*—Bradley K. Lortz; Vijayalakshmi D. Duraiswamy; Michael W. Sales

[57] ABSTRACT

A traveling wave tube incorporates a collector having a plurality of collector electrodes, one or more of which is operated at a potential below that of the cathode so as to collect electrons having associated energies greater than the cathode potential ($E_K$), and thereby act as a high impedance current source. The current from the collector electrode operated below the cathode potential ($E_K$) is converted by a power converter to an alternating current signal that can be either magnetically coupled to the high voltage transformer ($T_1$) of the traveling wave tube power supply, or coupled to an external load with a transformer ($T_2$), thereby improving the operating efficiency of the traveling wave tube system.

15 Claims, 6 Drawing Sheets

SYSTEM AND METHOD FOR RECOVERING POWER FROM A TRAVELING WAVE TUBE

TECHNICAL FIELD

The instant invention generally relates to traveling-wave tube systems and more particularly to systems and methods for improving the operating efficiency of traveling-wave tubes.

BACKGROUND ART

Traveling wave tubes are capable of amplifying and generating microwave signals over a considerable frequency range (e.g. 1–90 GHz) with relatively high output powers (e.g. >10 megawatts), relatively large signal gains (e.g. 60 dB), and over relatively broad bandwidths (e.g. >10%).

In a traveling wave tube, an electron gun generates a beam of electrons which are directed through a slow-wave structure and collected by a multi-electrode collector. A beam-focusing structure surrounding the slow-wave structure creates an axial magnetic field that contains the electron beam within the slow-wave structure. The slow-wave structure generally comprises either a helical conductor or a coupled cavity circuit with signal input and output ports located at opposite ends thereof, wherein a microwave signal applied to one of the ports propagates along the slow-wave structure to the other port at a projected axial velocity that is considerably less than the free space speed of light. With the velocity of the electron beam adjusted to be similar to the projected axial velocity of the microwave signal propagating along the slow-wave structure, the fields of the microwave signal and electron beam interact with one another so as to transfer energy from the electron beam to the microwave signal, thereby amplifying the microwave signal.

A traveling wave tube may be used as an amplifier by operatively coupling a microwave signal to be amplified to the signal input port of the slow-wave structure. The microwave signal propagates towards the signal output port in the same direction as the electron beam and becomes amplified by energy extracted from the electron beam. As a result of this energy exchange, the electron beam loses energy which reduces the velocity thereof.

A traveling wave tube may also be used as a backward-wave oscillator, wherein random, thermally generated noise interacts with the electron beam to generate a microwave signal in the slow-wave structure of the traveling wave tube. Energy is transferred to the microwave signal propagating along the slow-wave structure in a direction opposite to that of the electron beam, whereby the oscillator output signal is generated at the signal input port of the slow-wave structure, with the signal output port of the slow-wave structure terminated with a microwave load.

One problem with prior art traveling wave tubes is that the electrons are collected by collector electrodes in the multi-electrode collector that operate at respective potentials greater than or equal to the potential of the cathode. However, under certain conditions, particularly when a traveling wave tube is operated far below saturation (i.e. more than 10 dB), some of the electrons in the electron beam can have associated energies that are greater than the energy associated with the cathode potential. These relatively high energy electrons are a source of potentially recoverable energy that is not recovered by prior art traveling wave tube systems.

SUMMARY OF THE INVENTION

The instant invention overcomes the above-noted problems by providing a traveling wave tube system that incorporates a multi-electrode collector assembly, wherein one or more of the collector electrodes operates at a potential below the cathode potential, i.e. operates at a voltage that is more negative than the cathode, so that relatively high energy electrons impinging thereon are collected thereby so as to form electron current which flows into a power converter and is converted into useful power at the output of the power converter. The power converter may either feed power back into the traveling wave tube power supply, or provide power to an external load. The collector electrode connected to the power converter acts as a high impedance DC current source, the current from which is converted by the power converter to an AC signal which can be magnetically coupled to the high voltage power transformer or coupled by a transformer to a separate load. The power converter can be any convenient form, for example full or half bridge converters in resonant, quasi-resonant or pulse width modulated (PWM) implementations.

Collector depression voltages for a highly efficient traveling wave tube operating backed off from saturation include values more negative than the cathode voltage. As confirmed by computer simulation, the extra collector electrode operating at the depressed voltage is recovering energy from the spent electron beam by collecting electrons that have been accelerated to more than the cathode-body potential. A normal collector power supply cannot provide power to such an extra collector electrode because this collector electrode acts as a source of electrons into a more negative potential, whereas a normal power supply stage can only sink electrons into a positive potential and cannot utilize the electrons from such a more negative extra collector electrode. The energy from the extra collector electrode can be recovered outside the traveling wave tube by floating a power converter at the cathode potential to transfer energy from the collector to a place where it can be used.

The instant invention provides a method of operating a traveling wave tube wherein one or more collector electrodes of a multi-electrode collector is operated at a potential below that of the cathode. The electron beam entering each of the collectors is decelerated by the electric field created within the collector responsive to the distribution of voltages applied to the associated collector electrodes. Relatively high energy electrons within the electron beam are sufficiently energetic to bypass all collector electrodes operating at a potential at or above the cathode potential. These relatively high energy electrons are further decelerated by the electric field proximate the collector electrode operated at a potential below the cathode potential, and are captured thereby. The product of the equivalent positive current leaving the collector electrode times the associated negative voltage thereof results in a negative power consumed at the collector electrode. In other words, the current to the collector electrode is a source of power. This power is recovered in accordance with the instant invention by converting the current from the collector electrode to an alternating current signal that can be either magnetically coupled to the power supply transformer of the traveling wave tube system, or coupled to an external load via a transformer.

Accordingly, one object of the instant invention is to provide an improved traveling wave tube system, which operates more efficiently than prior art traveling wave tube systems, particularly under conditions when operating at power levels below saturation. Another object of the instant invention is to provide an improved traveling wave tube system, which recovers useful power from the electron beam in the traveling wave tube.

A further object of the instant invention is to provide an improved traveling wave tube system, which utilizes power recovered from the electron beam in the traveling wave tube to provide power for operating the traveling wave tube system. A still further object of the instant invention is to provide an improved method of operating a traveling wave tube, by which the operating efficiency of the traveling wave tube is improved, particularly when operating at power levels below saturation.

A yet further object of the instant invention is to provide an improved method of operating a traveling wave tube, by which otherwise wasted power is recovered from the electron beam in the traveling wave tube. And, another object of the present invention is to provide an improved method of operating a traveling wave tube, by which otherwise wasted power recovered from the electron beam in the traveling wave tube is used to operate the traveling wave tube system.

In accordance with these objectives, the instant invention provides for the collection of current from a traveling wave tube collector electrode operating at a potential below the cathode potential. The instant invention further provides for the conversion of the collected current into a useful form of power, such as, for example, by the conversion of the collected current to an alternating current for purposes of powering a load, or by the conversion of the collected current to an alternating magnetic field in the core of the power transformer of the traveling wave tube system so as to return power from the electron beam to the traveling wave tube.

An advantage of the instant invention with respect to the prior art is that by recovering current from the electron beam at a potential below the potential of the cathode, particularly when operating at power levels below saturation, the inventive traveling wave tube system operates more efficiently than prior art traveling wave tube systems, wherein useful electrical power is recovered from the electron beam for powering a load.

The instant invention will be more fully understood after reading the following detailed description of the preferred embodiment with reference to the accompanying drawings.

BRIEF DESCRIPTION OF THE DRAWINGS

FIG. 7 is a schematic diagram of a traveling wave tube power supply incorporating the instant invention;

BEST MODE(S) FOR CARRYING OUT THE INVENTION

Figure 1:
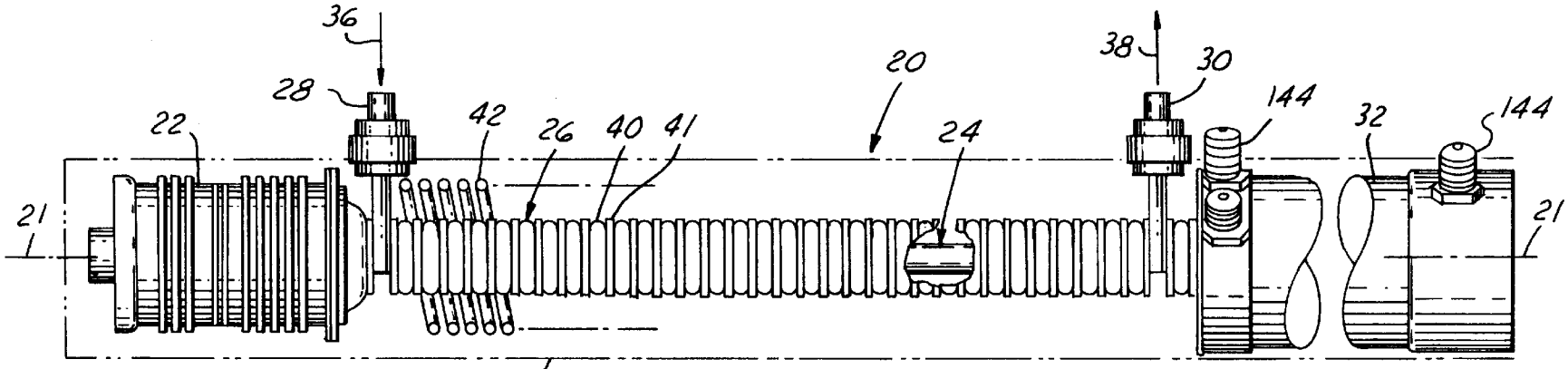
FIG.1 (PRIOR ART)
FIG. 1 is a partial cutaway side view of a prior art traveling wave tube.
Figure 2B:
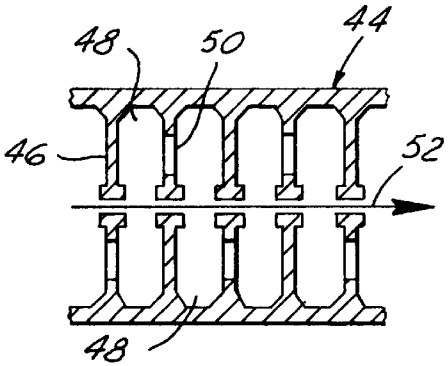
FIG.2B (PRIOR ART)
FIG. 2B illustrates another prior art slow-wave structure in the form of a coupled-cavity circuit incorporated in another embodiment of the traveling wave tube of FIG. 1.
Figure 2A:
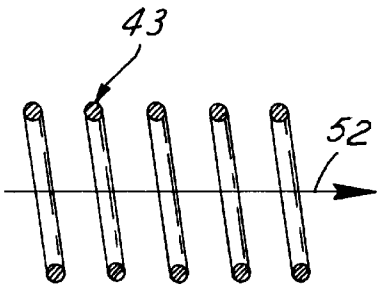
FIG.2A (PRIOR ART)
FIG. 2A illustrates a prior art slow-wave structure in the form of a helix incorporated in one embodiment of the traveling wave tube of FIG. 1.
Figure 3:
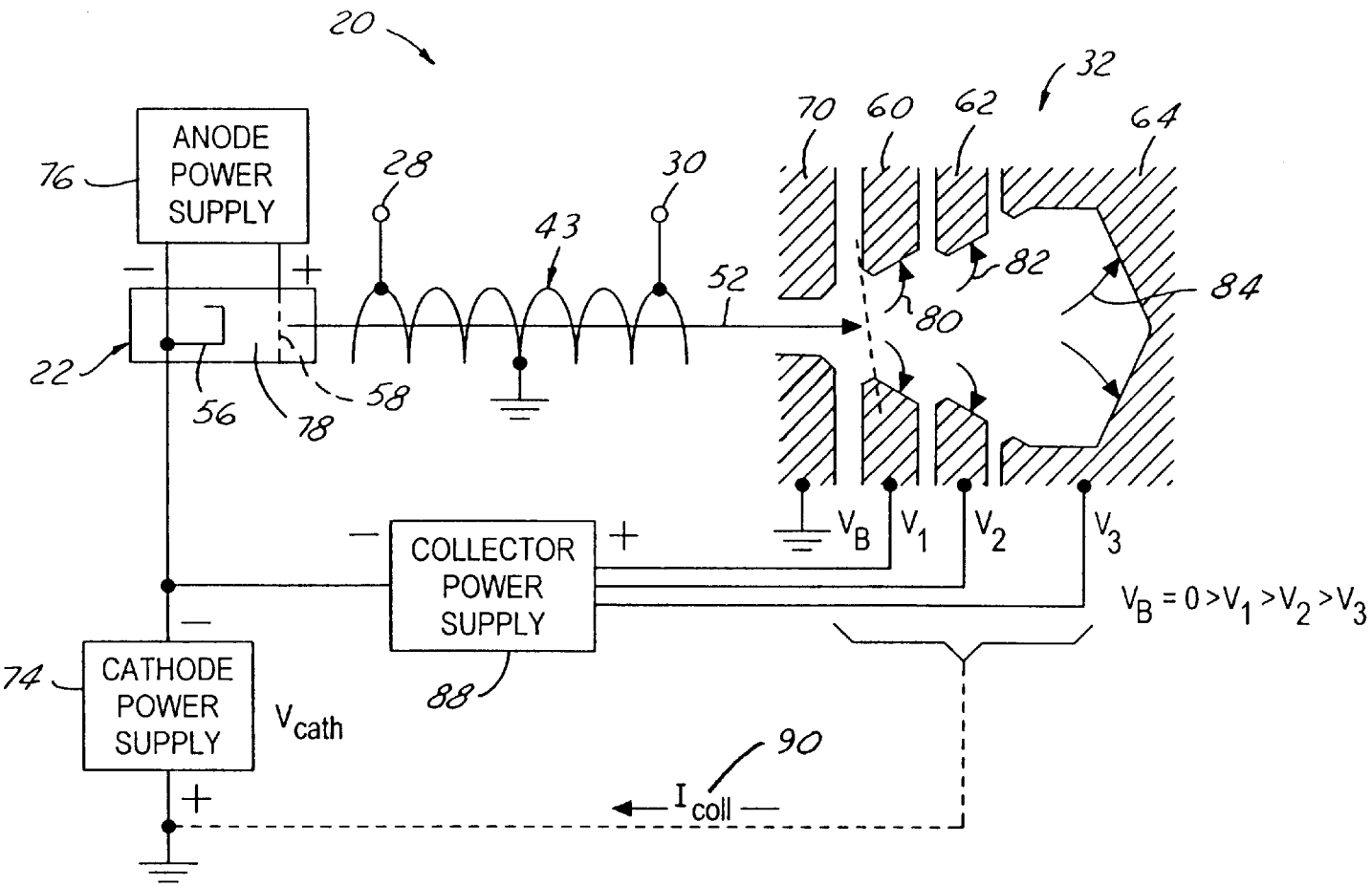
FIG. 3 (PRIOR ART)
FIG. 3 is a schematic of the traveling wave tube of FIG. 1 incorporating a multi-electrode collector.

Referring to FIGS. 1–3, an exemplary traveling-wave tube 20 comprises an electron gun 22, a slow-wave structure 24, a beam-focusing structure 26 surrounding the slow-wave structure 24, a signal input port 28 and a signal output port 30 coupled to opposite ends of the slow-wave structure 24, and a multi-electrode collector 32. Typically, a housing 34 protects the traveling wave tube elements.

Referring now to FIG. 3, the electron gun 22 comprises a heater (not shown), a cathode 56 and typically one or two anodes 58. With two anodes 58, one anode is generally used as an ion trap to prevent contamination of the cathode 56, whereas the other anode is used to control the cathode current. In operation, electrons are generated by the heater and emitted by the cathode 56 proximate thereto through a process of thermionic emission. An anode potential $E_A$ generally several thousand volts applied by the anode power supply 76 to the anode 58 relative to the cathode 56 causes the thermionically emitted electrons to accelerate in the acceleration region 78 therebetween, so as to generate an electron beam 52 from the electron gun 22, whereby the resulting electron beam current is dependent upon the magnitude of the anode potential $E_A$.

The slow wave structure, located adjacent to the electron gun 22, generally comprises either a helical structure 43, as illustrated in FIG. 2A, or a coupled cavity circuit 44, as illustrated in FIG. 2B. Referring again to FIG. 3, the slow wave structure 24 incorporates a signal input port 28 and a signal output port 30 at opposite ends of the slow wave structure. One of ordinary skill in the art will understand that the helical structure 43 may comprise either a monofilar helix constructed from a single conductor, a bifilar contra-wound helix constructed from two conductors, or modified versions thereof with appropriate performance characteristics. As shown in FIG. 2B, the coupled-cavity circuit 44 includes annular webs 46 which are axially spaced to form cavities 48. Each of the annular webs 46 forms a coupling hole 50 which couples a pair of adjacent cavities 48. The helical structure 43 is especially suited for broad-band applications while the coupled-cavity circuit 44 is especially suited for high-power applications.

Referring again to FIG. 1, the beam focusing structure 26 is coaxial with the slow wave structure 24 and incorporates either a linear periodic structure of annular permanent magnets 40 separated by annular pole pieces 41 (referred to as a periodic permanent magnetic, or PPM), or a current carrying linear solenoid 42, to generate an axial magnetic field along the traveling wave tube axis 21. The beam focusing structure causes the electrons in the electron beam 52, shown in FIG. 2A, 2B and 3, traveling along the slow wave structure to be contained therein by a process wherein the electrons in the electron beam 52 propagate in a tight helical path. Without the beam focusing structure the electrons would repel one another causing a radial dispersion of the electron beam. However, referring back to FIG. 1, the interaction of an electron moving normal to traveling wave tube axis 21 with an axial magnetic field generated by the beam focusing structure 26 creates a Lorentz force acting upon the electron in a direction normal to the direction of electron velocity, causing electron confinement. Traveling wave tubes 20 for which output power is more important than size and weight may incorporate a second beam-focusing configuration comprising a current carrying linear solenoid 42 powered by an associated solenoid power supply.

Referring to FIG. 3, the slow wave structure and the body 70 of the traveling wave tube 20 are set by the cathode power supply 74 to ground potential $E_0$, which is positive relative to the cathode 56 by the magnitude of the cathode potential $E_K$, so as to accelerate the electrons in the electron beam 52 from the electron gun 22 to a velocity that is dependent upon the magnitude of the cathode potential $E_K$.

The operation can be described with reference to FIG. 1. A beam of electrons is launched from the electron gun 22 into the slow-wave structure 24 and is guided through that structure by the beam-focusing structure 26. A microwave signal 36 operatively coupled to the signal input port 28 propagates along the slow wave structure 24 to the signal output port 30 at a projected axial velocity that is substantially less than the speed of light, as a result of both the electrical and the geometrical properties of the slow wave structure 24. The ratio of the axial guided wave velocity to the corresponding free space velocity is referred to as the velocity factor.

By a combination of the velocity factor of the slow wave structure 24 and the cathode potential $E_K$, the axial velocities of the microwave signal and the electron beam are adapted to be comparable to one another so that interaction of the electric fields of the microwave signal and the electron beam 52 causes the electrons in the electron beam 52 to be velocity-modulated into bunches which overtake and interact with the slower microwave signal causing kinetic energy to be transferred from the electron beam to the microwave signal, thereby amplifying the microwave signal while simultaneously slowing the velocity of the electrons in the electron beam. The interaction of the microwave signal with the electron beam also results in a dispersion of electron velocity, or kinetic energy, of the electrons in the electron beam. The amplified microwave signal 38 exits at the signal output port 30. After passing through the slow-wave structure 24, the electrons in the electron beam are collected by the multi-electrode collector 32.

Referring again to FIG. 31 the multi-electrode collector 32 comprises a first annular collector electrode 60, a second annular collector electrode 62 and a third collector electrode 64. Relative to the slow wave structure 43 and a body 70 of the traveling wave tube 20, which are at ground potential, the cathode 56 is negatively biased at a voltage $V_{cath}$ supplied by cathode power supply 74 having positive and negative terminals denoted by (+, −) respectively in FIG. 3. An anode power supply 76, also having positive and negative terminals (+, −), referenced to the cathode 56 biases the anode 58 relatively positive, thereby establishing between the cathode 56 and the anode 58 an acceleration region 78 through which electrons emitted by the cathode 56 are accelerated so as to form the electron beam 52.

The electron beam 52 travels through the slow-wave structure 43, which is shown as a helical structure 43, exchanging energy with a microwave signal propagating along the slow-wave structure 43 from the signal input port 28 to the signal output port 30. A portion of the kinetic energy of the electron beam 52 is lost in this energy exchange, but most of the kinetic energy remains in the electron beam 52 as it enters the multi-electrode collector 32. A significant part of this kinetic energy can be recovered by decelerating the electrons before they are collected at the collector walls.

The electrons comprising the electron beam 52 form a negative "space charge" that would disperse radially without the influence of the axial magnetic field created by the beam-focusing structure 26, where the poles of permanent magnets 40 and 41 are denoted by N and S for north and south magnetic poles respectively. However, upon entering the multi-electrode collector 32, the electron beam 52 is no longer under this influence and consequently the electrons comprising the electron beam 52 begin to radially disperse. Furthermore, as a result of the interaction between the electron beam 52 and the microwave signal propagating on the slow-wave structure 24, the electrons of the electron beam 52 exhibit a range of velocities and associated kinetic energies upon entry to the multi-electrode collector 32.

The electrons of the electron beam 52 are decelerated within the multi-electrode collector 32 by setting the voltage of the associated collector electrodes relatively negative with respect to the traveling wave tube body 70. Kinetic energy is recovered from the electron beam by collecting electrons at an electrical potential that is lower than that of the traveling wave tube body 70, thereby improving the operating efficiency of the traveling wave tube 20. The operating efficiency is further enhanced with a multi-electrode collector 32, wherein the electrical potential of each successive electrode is progressively depressed from the body potential of $V_B$. For example, if the first annular collector electrode 60 has a potential $V_1$, the second annular collector electrode 62 has a potential $V_2$ and the third collector electrode 64 has a potential $V_3$, then typically $V_B=0>V_1>V_2>V_3$ as indicated in FIG. 3.

The voltage $V_1$ on the first annular collector electrode 60 is sufficiently depressed so as to decelerate the low kinetic energy electrons 80 in the electron beam 52 and yet still collect them. If this voltage $V_1$ is depressed too far, the low kinetic energy electrons 80 will be repelled from, rather than being collected by, the first annular collector electrode 60. The repelled electrons may either flow to the traveling wave tube body 70 where they are collected at the maximum electrical potential of the system, thereby reducing the operating efficiency of the traveling wave tube 20, or they may reenter the energy exchange area of the helical structure 43, producing undesirable feedback that reduces the stability of the traveling wave tube 20.

Progressively depressed voltages are applied to successive collector electrodes to decelerate and collect progressively faster electrons in the electron beam 52. For example, higher energy electrons 82 are collected by the second annular collector electrode 62 and highest energy electrons 84 are collected by the third collector electrode 64.

In operation, the diverging low kinetic energy electrons 80 are repelled by the second annular collector electrode 62, causing their divergent path to be modified so that they are collected on the interior face of the less depressed first annular collector electrode 60. Higher energy electrons 82 are repelled by the third collector electrode 64, causing their divergent paths to be modified so that they are collected on the interior face of the less depressed second annular collector electrode 62. Finally, the highest energy electrons 84 are decelerated and collected by the third collector electrode 64. This process of improving traveling wave tube efficiency by decelerating and collecting progressively faster electrons with progressively greater depression on successive collector electrodes is generally referred to as "velocity sorting".

Although the example described above utilizes three depressed collector electrodes, it is to be understood that any number of collector electrodes can be utilized and that larger numbers are in general use today.

The improvement in operating efficiency gain as a result of velocity sorting of the electron beam 52 can be further understood with reference to current flows through the collector power supply 88 coupled between the cathode 56 and the collector electrodes 60, 62 and 64. If the potential of the electrodes of the multi-electrode collector 32 was the same as the traveling wave tube body 70, the total collector electron current $I_{coll}$ would flow back to the cathode power supply 74 as indicated by the current 90 in FIG. 3, and the input power to the traveling wave tube 20 would substantially be the product of the cathode voltage $V_{cath}$ and the collector current $I_{coll}$. With progressively decreasing potentials applied to the successive electrodes of the multi-electrode collector 32, the input power associated with each collector electrode is the product of associated current from, and voltage of, the respective collector electrode. Because the voltages $V_1$, $V_2$ and $V_3$ of the collector power supply 88 are a fraction (e.g., in the range of 30–70%) of the voltage of the cathode power supply 74, the traveling wave tube input power is effectively decreased thereby increasing the operating efficiency of the traveling wave tube 20.

Figure 4:
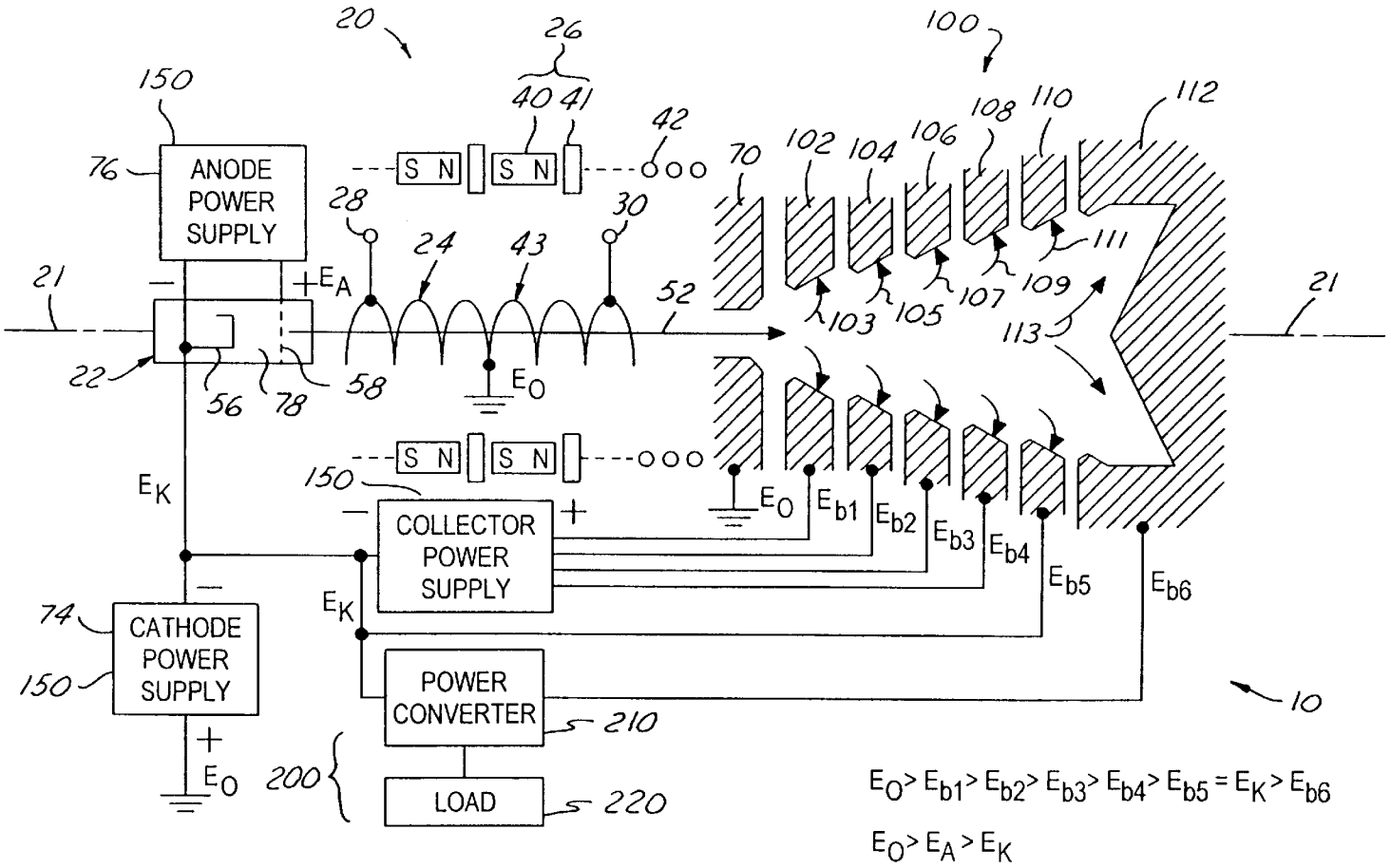
FIG. 4 is a schematic of a traveling wave tube system in accordance with the instant invention.

Referring to FIG. 4, where like reference numbers and symbols denote like elements as described with reference to FIGS. 1–3, a traveling wave tube system 10 comprises a traveling wave tube 20, a traveling wave tube power supply 150 having positive and negative terminals (+,–), for supplying power thereto, and a power converter 210 for recovering power from the traveling wave tube 20. The traveling wave tube 20 comprises an electron gun 22, a slow wave structure 24, a beam focusing structure 26, and a collector 100 disposed along a common traveling wave tube axis 21.

Under relatively low power operating conditions, only a portion of the kinetic energy of the electron beam 52 is lost in this process of energy exchange with the microwave signal propagating along the slow wave structure 24, whereas a majority of the kinetic energy remains in the electron beam 52 as it enters the collector 100. The process of collecting electrons from the electron beam results in a dissipation of energy, wherein the amount of energy dissipated is given by the product of the electron beam current times the voltage at the point of collection. More particularly, a maximum amount of power would be dissipated if the electrons were collected at the maximum potential of the system, i.e. the potential of the body 70 of the traveling wave tube 20 relative to the cathode ($|E_K|$ with $E_0$=0). Electrons in the electron beam 52 collected at the same potential $E_K$ as the cathode 56, cause no dissipation of energy. Electrons collected at a potential below the potential $E_K$ of the cathode 56 are a source of recoverable energy. A significant amount of the kinetic energy remaining in the electron beam 52 passing into the collector 100 can be recovered by decelerating the electrons with the electric field created within collector 100, before they are collected at the collector walls so as to enable the collection of electrons at a low potential relative to that of the cathode 56.

The collector 100 comprises a plurality of annular collector electrodes 102, 104, 106, 108, and 110 and a cup-like electrode 112 disposed along a common axis 21 adjacent to one another progressively further away from the outlet of the slow wave structure 24, wherein each respective collector electrode is set to a corresponding electric potential adapted to create an electric field which causes electrons traveling into collector 100 to be decelerated therein. More particularly, the collector electrodes 102, 104, 106, 108, and 110 are respectively set to potentials $E_{b1}$, $E_{b2}$, $E_{b3}$, $E_{b4}$, and $E_{b5}$ which are progressively less positive relative to the cathode 56, with the potential $E_{b5}$ of collector electrode being equal to the potential of the cathode electrode. This relationship is shown in the legend at the bottom of FIG. 4. The electrons are decelerated by the electric field within the collector 100. Preferably, the design of the electrodes within collector 100 and the levels of the corresponding potentials are adjusted to minimize the dissipation of power by the electron beam 52.

For an electron beam 52 comprising electrons having a range of energies, the lowest energy electrons 103 are collected by annular collector electrode 102 at potential $E_{b1}$. If the potential of $E_{b1}$ is set too close to $E_k$, some or all of the lowest energy electrons 103 would be repelled thereby causing them to be collected by the traveling wave tube body 70 resulting in a correspondingly higher dissipation and reduced efficiency. Some or all of these repelled electrons can also reenter the energy exchange area of the slow wave structure 24 resulting in undesirable feedback that reduces the stability of the traveling wave tube 20.

Higher energy electrons 105, having an energy too great to be captured by annular collector electrode 102 but not great enough to escape the attraction of annular collector electrode 104 are repelled by annular collector electrode 106 and captured by annular collector electrode 104. Similarly, yet higher energy electrons 107, having an energy too great to be captured by annular collector electrode 104 but not great enough to escape the attraction of annular collector electrode 106 are repelled by annular collector electrode 108 and captured by annular collector electrode 106. Similarly, yet higher energy electrons 109, having an energy too great to be captured by annular collector electrode 106 but not great enough to escape the attraction of annular collector electrode 108 are repelled by annular collector electrode 110 and captured by annular collector electrode 108. Similarly, yet higher energy electrons 111, having an energy too great to be captured by annular collector electrode 108 but not great enough to escape the attraction of annular collector electrode 110 are repelled by annular collector electrode 112 and captured by annular collector electrode 110. Finally, the highest energy electrons 113 are captured by cup-like electrode 112.

The distribution of velocity of the electrons in the electron beam 52 is dependent upon the operating state of the traveling wave tube 20. For example, when the tube is generating RF power, the velocity of the electrons in the electron beam is distributed over a range of energies with some electrons having greater energies than the original beam energy. In this case, the highest energy electrons 113 are sufficiently energetic to escape collection by the annular collector electrode 110 at a potential $E_{b5}=E_K$ and be collected by the cup-like electrode 112 at potential $E_{b6}$, that is, below the potential $E_K$ of the cathode 56, thereby resulting in an electron flow from cup-like electrode 112 which is a source of power. The cup-like electrode 112 is operatively coupled to a power converter 210 which recovers and converts this power to a useful form, such as being used to power a load 220. The potential $E_{b6}$ is either set by a voltage source, or more preferably floats in accordance with the collection of the highest energy electrons 113 by the cup-like electrode 112. The potential $E_{b6}$ is typically about 200 to 600 volts below the potential $E_K$ Of the cathode 56.

As the power of the traveling wave tube 20 is increased, the average electron velocity of the electrons in the electron beam 52 decreases, and the variation in the distribution increases, generally reducing the number of electrons collected by the cup-like electrode 112. At a sufficiently high power, substantially all of the highest energy electrons 113 are collected by collector electrodes other than the cup-like electrode 112, at which point substantially no power is recovered from the electron beam 52. Typically, the instant invention is most effective at recovering power from the electron beam 52 at power levels about 10 dB below the saturation power level, for which the linearity of the traveling wave tube amplifier is relatively high.

Typically, the potentials $E_{b1}$, $E_{b2}$, $E_{b3}$, $E_{b4}$, and $E_{b5}$ of the respective annular collector electrodes 102, 104, 106, 108 and 110 are adjusted to minimize the overall power consumption of the traveling wave tube system 10.

The collector electrodes 102, 104, 106, 108, 110 and 112 are preferably formed of a material, e.g., graphite or copper, which has low electrical and thermal resistances. An annular isolator (not shown) electrically isolates the collector electrodes from the annular collector body (not shown) and conducts heat from the collector electrodes to the annular collector body, and is preferably formed of a ceramic such as alumina or beryllia.

The instant invention provides a general means for recovering power from the electron beam 52 of a traveling wave tube 20 regardless of the configuration of the collector 100. More particularly, the instant invention is not limited by the number or placement of electrodes in the collector 100 or by the use of magnets to control electron trajectories in the collector.

Figure 5:
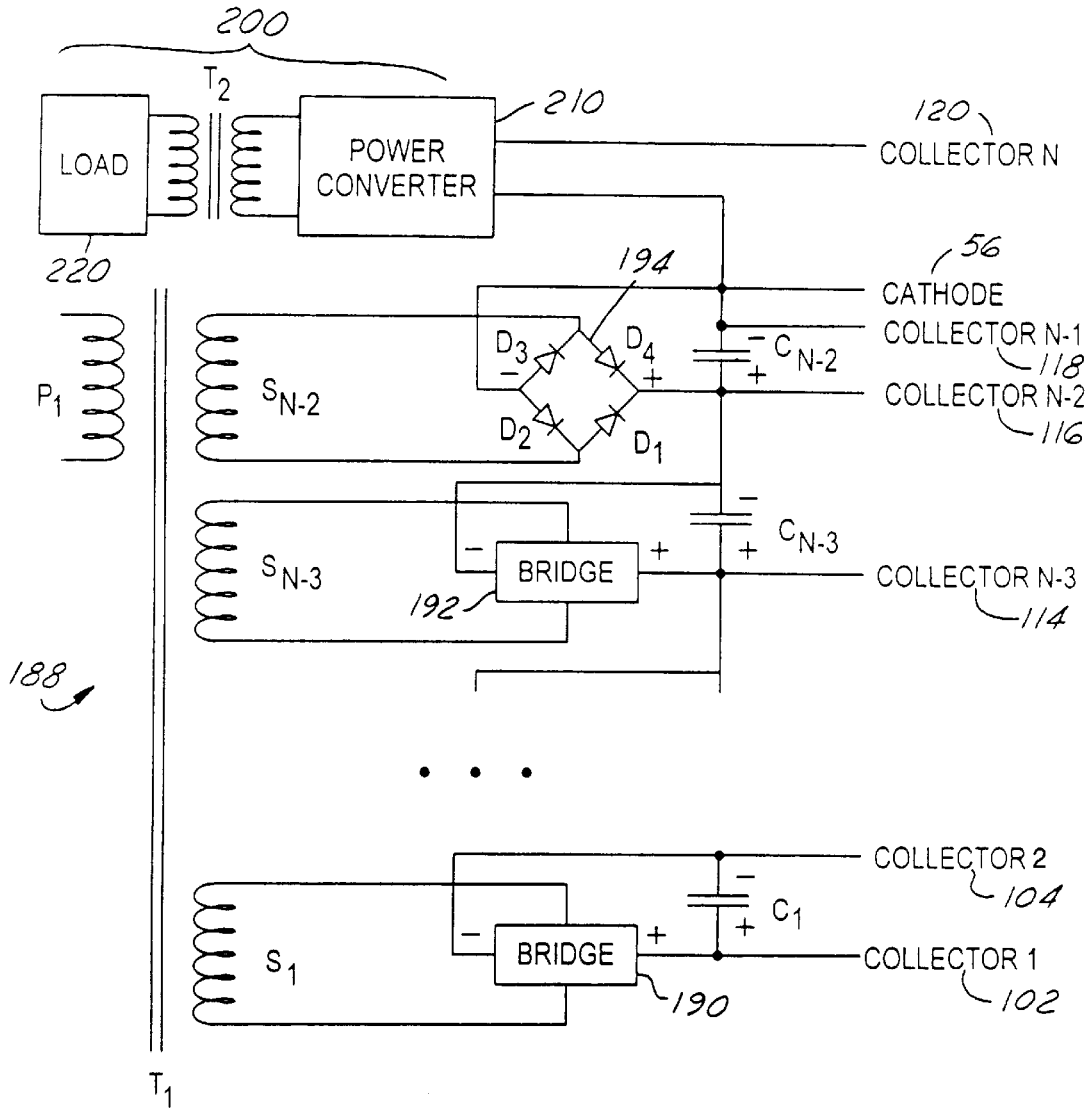
FIG. 5 is a schematic diagram of a traveling wave tube power supply incorporating the instant invention.

Referring to FIG. 5, a collector power supply 188 for a collector with N collector electrodes comprises a transformer T1 having a primary winding P1 and N-2 secondary windings $S_1$, . . . , $S_{N-3}$, $S_{N-2}$. Each secondary winding supplies an alternating current (AC) signal to an associated full wave bridge rectifier, the direct current (DC) output of which is connected to an associated filter capacitor, wherein the associated full wave bridge rectifier rectifies the AC signal from the secondary winding and charges the associated capacitor to the associated DC potential, so as to constitute N-2 associated DC power supply stages.

More particularly, full wave bridge rectifier 194 comprising diodes D1, D2, D3, and D4 rectifies the AC signal from secondary winding $S_{N-2}$ and charges capacitor $C_{N-2}$. In accordance with one embodiment of the instant invention, for a collector with N collector electrodes, the (N-3)th collector electrode 118 has the same potential as the cathode 56. Accordingly, the negative DC output terminal (−) of full wave bridge rectifier 194 is connected to both the cathode 56 and to the (N-1)th collector electrode 118, and the positive DC output terminal (+) of full wave bridge rectifier 194 is connected to the (N-2)th collector electrode 116, whereby the (N-2)th collector electrode 116 is more positive than (N-1)th collector electrode 118.

Similarly, bridge rectifier 192 rectifies the AC signal from secondary winding $S_{N-3}$ and charges capacitor $C_{N-3}$. The negative DC output terminal (−)of bridge rectifier 192 is connected to the (N-2)th collector electrode 116, and the positive DC output terminal (+) of bridge rectifier 192 is connected to the collector electrode 114, whereby the (N-3) th collector electrode 114 is more positive thank (N-2)th collector electrode 116.

Successive DC power supply stages are applied across each successive pair of collector electrodes such that each successive collector electrode is more positive that its predecessor. Finally bridge rectifier 190 rectifies the AC signal from secondary winding $S_1$ and charges capacitor $C_1$. The negative DC output terminal (−) of bridge rectifier 190 is connected to the second collector electrode 104, and the positive DC output terminal (+) of bridge rectifier 190 is connected to the first collector electrode 102, whereby the first collector electrode 102 is more positive than the second collector electrode 104.

As described hereinabove, the Nth collector electrode 120 operates at a depressed voltage relative to the cathode 56 and is a source of electrons to the power converter 210, which as illustrated in FIG. 5 is floated relative to the cathode for purposes of transferring energy from the Nth collector electrode 120 to a load 220. The Nth collector electrode 120 gathers electrons at energies several hundred volts more negative than the cathode potential. The power converter 200 can be of any form known to one of ordinary skill in the art, including full and half bridge converters in resonant, quasi-resonant, and pulse width modulated (PWM) embodiments. The power converter 210 generates an AC signal that is then coupled to the load 220 via a transformer $T_2$. If for a given application the potential of one terminal of the load 220 is inherently equal to the cathode potential, then the transformer $T_2$ is not necessary.

Figure 6:
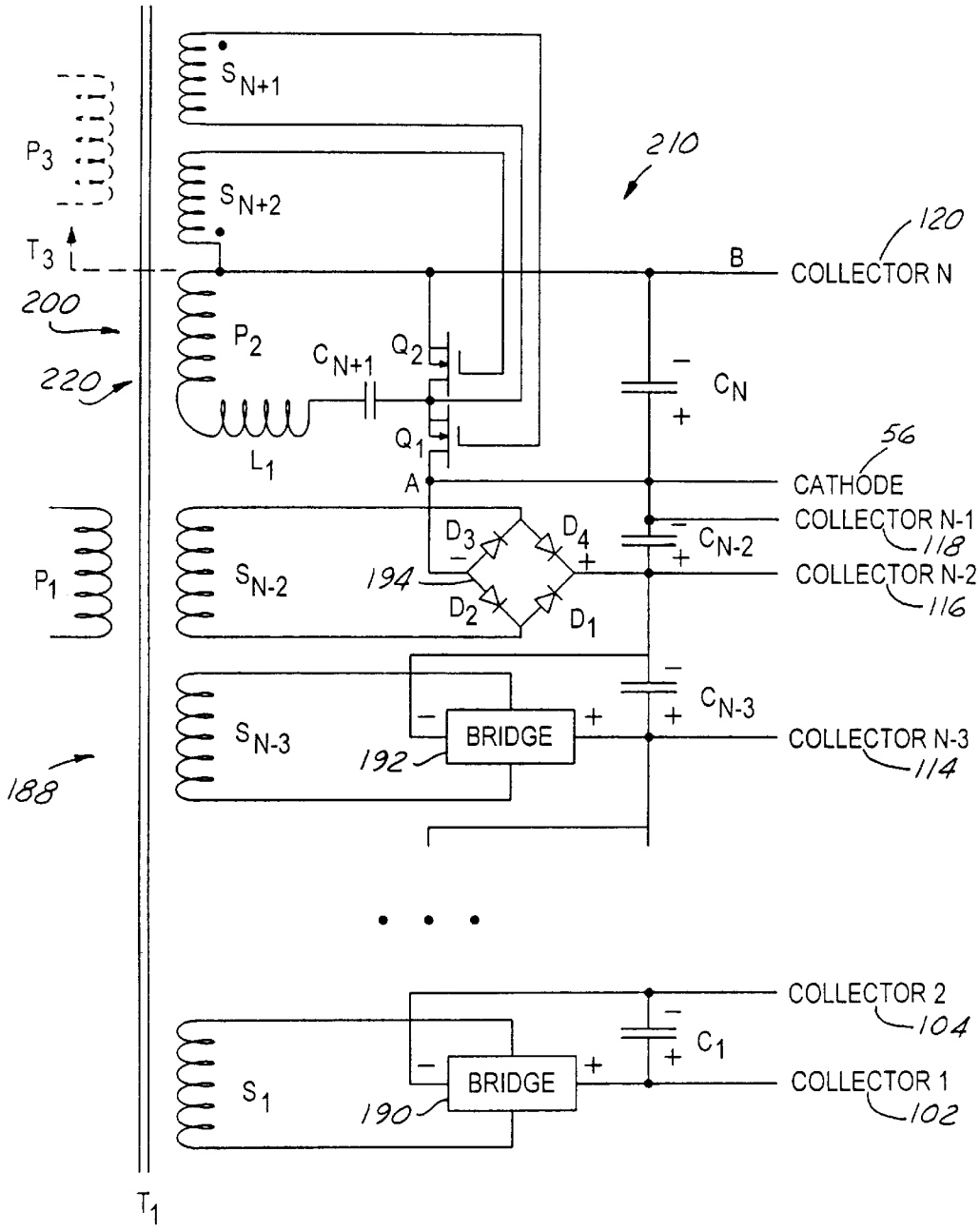
FIG. 6 is a schematic diagram of a traveling wave tube power supply incorporating the instant invention, wherein converted power is operatively coupled back into the power supply transformer.

Referring to FIG. 6, were like elements are described by like reference numbers as described with reference to FIG. 5. a collector power supply 188 for a collector 100 with N collector electrodes comprises a transformer T1 having a primary winding P1 and N-2 secondary windings $S_1$, . . . , $S_{M-3}$. $S_{N-2}$, incorporated in an a plurality of associated N-2 DC power supply stages as illustrated in FIG. 5 and described hereinabove in association therewith. A half bridge resonant power converter 210 connected across the Nth collector electrode 120 and the cathode 56 is provided for recovering power from the Nth collector electrode 120, and for converting the DC electron current from the Nth collector electrode 120 to an AC current in the primary P2 of transformer T1, thereby returning power to the collector power supply 188. The half bridge resonant power converter 210 comprises MOSFET power transistors $Q_1$ and $Q_2$ in the respective arms of the half bridge. Capacitor $C_{N-2}$ is connected across the half bridge to store and provide DC power for the half bridge from the potential generated across the Nth and (N-1)th collector electrodes by the action of the relatively high energy electrons collected by the Nth collector electrode. Secondary windings $S_{N+1}$ and $S_{N+2}$ on transformer $T_3$ provide AC signals of opposite phase from one another across the gate-drain junctions of respective transistors $Q_1$ and $Q_2$, thereby alternately activating and deactivating transistor $Q_1$ in phase with the AC signal applied to primary winding $P_1$, and alternately deactivating and activating transistor $Q_1$, such that transistor $Q_1$ is switched on when transistor $Q_2$ is switched off, and vice versa. When transistor $Q_1$ is switched on the series resonant circuit formed by inductor $L_1$, capacitor $C_{N+1}$ and primary winding $P_2$ charges, causing current flows through primary winding $P_1$ in one direction, whereas when transistor $Q_2$ is switched on the series resonant circuit discharges, causing current flows through primary winding $P_2$ in the opposite direction, so that the resulting AC current in primary winding $P_2$, which is in phase with the current in primary winding $P_1$, increases the ampere-turns of transformer $T_1$ thereby recovering power.

In accordance with the arrangement of FIG. 6, the auxiliary transformer $T_2$ illustrated in FIG. 5 is not required since the load for the floating power converter 210 is the main high voltage transformer $T_1$ of the traveling wave tube system 10. The normal derating of readily available devices limits this arrangement to about 500 volts across the half wave bridge; however, several switching power converters could be combined in series to operate with any voltage level. The resonant circuit in this arrangement is adjusted, in accordance with principles and techniques known by one of ordinary skill in the art, so as to maximize the amount of power recovery. Primary winding $P_2$ is an extra winding on transformer $T_1$, and preferably the associated cathode lead is placed close to the center of the previous winding to avoid capacitively coupled ripple. If the frequencies of the main high voltage transformer $T_1$ and the heater transformer $T_3$ are the same, the gate drive winding can be located on the heater transformer $T_3$, likely without any additional insulation, otherwise, the gate drive winding would preferably be located on a separate transformer $T_3$ having an associated primary winding $P_3$.

Referring to FIG. 7, a traveling wave tube system 10 incorporates a traveling wave tube 20 with a collector 100 having six collector electrodes 102, 104, 106, 108, 110, and 112. A traveling wave tube power supply 150 comprises a collector power supply. 188 powered by the main high voltage transformer $T_1$, a cathode power supply 74 that is an integral part of the collector power supply 188, and an anode power supply 76 comprising a secondary winding $S_A$ together with an anode power supply circuit 77 that supplies to the anode 58 a controllable DC potential $E_A$—typically in the range of several thousand volts—relative to the cathode potential $E_K$. The collector power supply 188 comprises a plurality of power supply stages 187, each of which as in FIGS. 5 and 6 comprises a respective secondary winding ($S_5$, $S_4$, $S_3$, $S_2$, $S_1$, and $S_0$), a respective bridge rectifier (194, 196, 195, 193, 191, 189) powered by the associated secondary winding, and a respective filter capacitor ($C_5$, $C_4$, $C_3$, $C_2$, $C_1$, $C_0$) in parallel with the output of the associated bridge rectifier. The successive power supply stages 187 are floated relative to one another and are connected in series so as to generate a progressively increasing set of potentials that are applied to the associated collector electrodes 110, 108, 106, 104, and 102, and the slow wave structure 24 and traveling wave tube body 70 through associated arc current limiting resistors ($R_6$, $R_5$, $R_4$, $R_3$, $R_2$, $R_1$, and $R_0$) . The coupled power supply stages 187 generate a progressive set of potentials, such that relative to the cathode, the slow wave structure 24 and traveling wave tube body 70 is most positive so as to attract electrons from the electron gun 22, and the potentials of successive collector electrodes along the trajectory of the electron beam 52 are progressively less positive, with the fifth collector electrode 110 having the same potential $E_K$ as the cathode 56. For example, in one particular configuration, the potential of the slow wave structure 24 and traveling wave tube body 70 relative to the cathode is 6850 V, and the potentials $E_{b1}$, $E_{b2}$, $E_{b3}$, and $E_{b4}$ of the first four collector electrodes 102, 104, 106 and 108 are respectively 2380 V, 1610 V, 900 V and 500 V, so as to create an electric field within the collector 100 which decelerates the electrons in the electron beam 52 thereby facilitating collection thereof by a collector electrode having a relatively low potential. The cathode power supply 74 essentially comprises the series combination of all power supply stages 187, together with an active filter 186 for removing ripple from the cathode voltage signal.

Figure 7A:
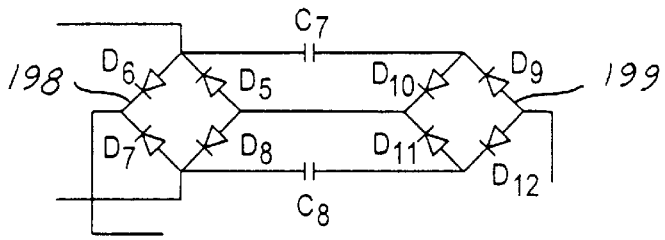
FIG. 7A is a schematic diagram of one embodiment of a bridge rectifier in accordance with the schematic diagram of FIG. 7.

The bridge rectifiers 194, 196, 195, 193, 191, 189 may be either an elementary full wave diode bridge rectifier 194 or, as illustrated in FIG. 7*a*, may comprise a plurality of elementary full wave diode bridge rectifiers 198, 199 which are floated relative to one another with coupling capacitors C7 and C8. Furthermore, several power supply stages 187 may be combined as illustrated in FIG. 7 for the power supply stages associated with capacitors $C_0$ and $C_1$.

The sixth collector electrode 112 operates at a potential $E_{b6}$ below the cathode potential $E_K$—about −500 V to −600 V in the example of FIG. 7—and furthermore is a source of electrons. A power converter and load system 200 is operatively coupled between the sixth collector electrode 112 and the fifth collector electrode 110 as indicated by reference points A and B in FIG. 7.

Figure 8:
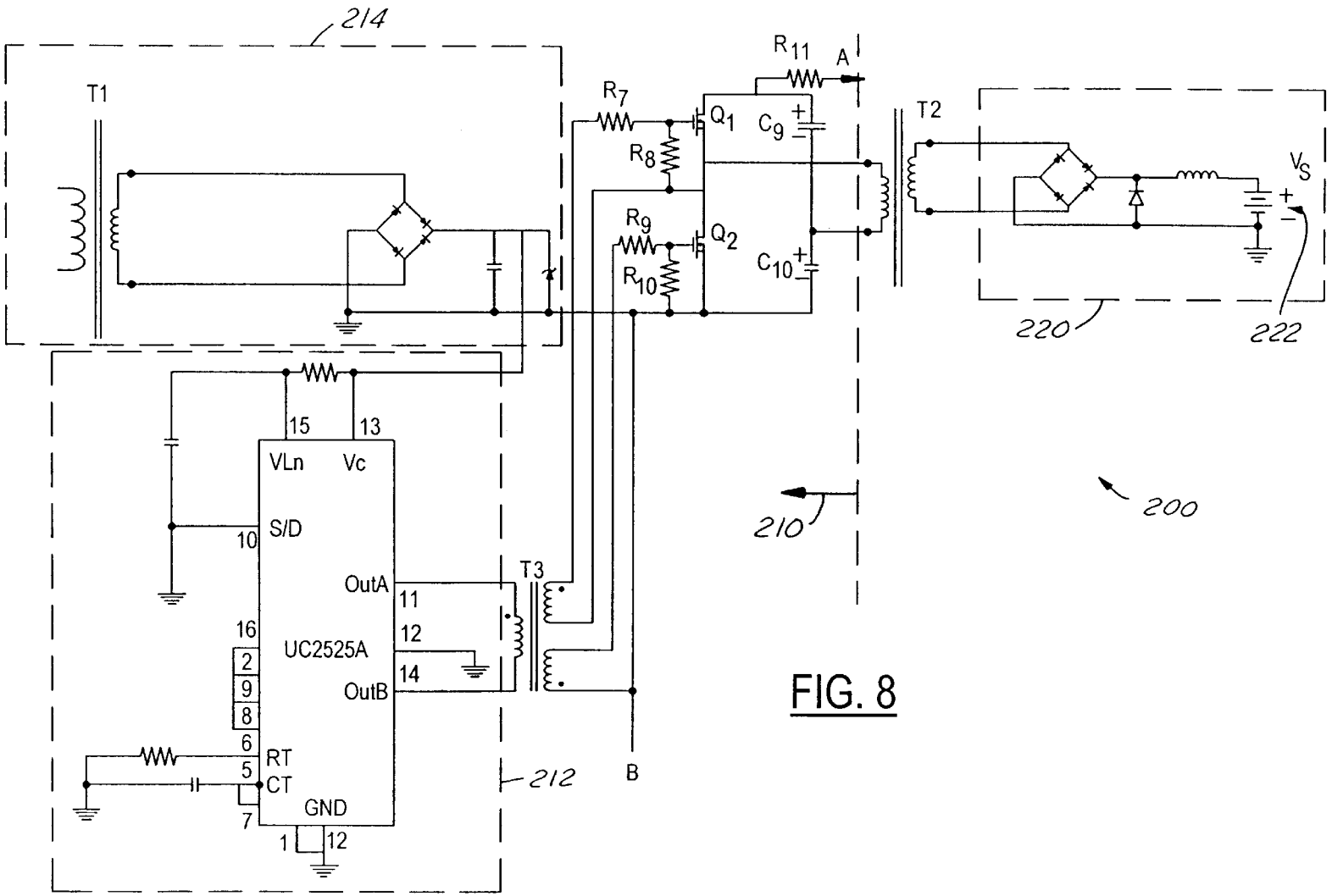
FIG. 8 is a schematic diagram of a half-bridge power converter operatively coupled to a load, in accordance with the instant invention.

Referring to FIG. 8, the power converter and load system 200 comprises an oscillator system 212, powered by an oscillator system power supply 214, which generates an alternating current in the primary of transformer $T_3$. This arrangement is particularly useful when practical considerations require a switching frequency that is higher than that available from transformer $T_1$ as illustrated in FIG. 6. The oscillator system 212 includes integrated circuit UC2525A as the associated oscillator, and the pin configuration for the integrated circuit is denoted by labels 1, 2, 5, and 6–16. Reference points A and B in FIG. 8 correspond to those in FIG. 7. The associated pair of secondary windings of transformer $T_3$ generate opposite phase AC signals, each of which controls through bias resistors $R_7$, $R_8$ and $R_9$, $R_{10}$ the gate-source junctions of respective MOSFET power transistors $Q_1$ and $Q_2$ connected in series so as to constitute a half-bridge, across which is connected the series combination of capacitors $C_9$ and $C_{10}$. With the junction between transistors $Q_1$ and $Q_2$ comprising a first node, and the junction between capacitors $C_9$ and $C_{10}$ comprising a second node, the primary winding of transformer $T_2$ is connected across the first and second nodes. The secondary winding of transformer $T_2$ powers a load 220 comprising a rectified power supply that charges a battery 222.

In operation, the potential across the series combination of capacitors $C_9$ and $C_{10}$ is governed by the voltage of the sixth collector electrode 112, which is dependent upon the capture of relatively high energy electrons by the sixth collector electrode 112. The sixth collector electrode 112 appears in the circuit as a high impedance current source, in this case a current source of about 0.135 amperes as determined by the associated rate of electron collection. Since the sixth collector electrode 112 functions has a high impedance current source, the voltage across the power converter 210—across reference points A and B—can be any reasonable value which allows electrons to be collected. Capacitors $C_9$ and $C_{10}$ divide this potential at the second node. Because the transistors $Q_1$ and $Q_2$ are driven out of phase by transformer $T_3$, when transistor $Q_1$ is switched on, transistor $Q_2$ is switched off, and vice versa. Accordingly, in alternate switching cycles, the first node is alternately set to a potential higher than and lower than the second node, thereby causing an alternating current to flow in the primary winding of transformer $T_2$, which in turn powers the associated secondary winding and load 220. The amount of recovered power is given by the product of the current flowing into the battery 222 times the associated battery value.

One of ordinary skill in the art will appreciate that the instant invention is not limited by the particular configuration of the associated traveling wave tube 20. For example, while a traveling wave tube with six collector electrodes has been described, the instant invention can be incorporated into a traveling wave tube 20 with any number of collector electrodes.

While specific embodiments have been described in detail, those with ordinary skill in the art will appreciate that various modifications and alternatives to those details could be developed in light of the overall teachings of the disclosure. Accordingly, the particular arrangements disclosed are meant to be illustrative only and not limiting as to the scope of the invention, which is to be given the full breadth of the appended claims and any and all equivalents thereof.

What is claimed is:

1. A traveling wave tube system comprising:

a) a traveling wave tube, comprising:

i) an electron gun comprising a cathode having a potential applied thereto and at least one anode, wherein said electron gun generates a beam of electrons;

ii) a slow-wave structure having an annulus through which said electron beam passes, wherein an electromagnetic signal coupled to said slow wave structure propagates along said slow wave structure and interacts with said electron beam so as to absorb energy therefrom;

iii) a beam-focusing structure for axially confining said electron beam within said slow-wave structure; and iv) a collector for collecting electrons from said electron beam, said collector comprising a plurality of collector electrodes;

b) a power supply for supplying power to said traveling wave tube; and c) a power converter having a DC input and a DC output, wherein said DC input is operatively coupled to one of said plurality of collector electrodes, said one of said plurality of collector electrodes operates at a potential below the potential of said cathode and collects relatively high energy electrons so as to provide an electron current which flows into said DC input of said power converter, whereby said power converter converts said electron current into useful power at said DC output of said power converter.

2. The traveling wave tube system as recited in claim 1, further comprising an electrical load operatively coupled to the DC. output of said power converter.

3. The traveling wave tube system as recited in claim 2, wherein said electrical load consumes said useful power.

4. The traveling wave tube system as recited in claim 3, wherein said electrical load comprises a power consuming element within said power supply.

5. The traveling wave tube system as recited in claim 2, further comprising an electrical transformer interposed between said DC. output of said power converter and said electrical load.

6. The traveling wave tube system as recited in claim 2, wherein said electrical load comprises an inductor which is magnetically coupled to a transformer incorporated in said power supply whereby said inductor transfers said useful power to said transformer.

7. The traveling wave tube system as recited in claim 1, wherein said power converter comprises a device selected from the group consisting of a half bridge power converter, a resonant half bridge power converter, a quasi-resonant half bridge power converter, a pulse width modulated half bridge power converter, a full bridge power converter, a resonant full bridge power converter, a quasi-resonant full bridge power converter, a pulse width modulated full bridge power converter, a parallel center-topped converter, and an AC converter.

8. The traveling wave tube system as recited in claim 7, wherein said power converter comprises said half bridge power converter comprising:

a) a pair of first and second transistor switches interconnected at a first node, said first and second transistor switches each having an input;

b) a first oscillatory signal operatively connected to the input of said first transistor switch through a first combination of impedance elements;

c) a second oscillatory signal operatively connected to the input of said second transistor switch through a second combination of impedance elements, whereby said second oscillatory signal is of opposite phase to said first oscillatory signal; and d) a series combination of capacitors interconnected at a second node, the input of said power converter is applied across said pair of first and second transistor switches, said signal output port of said power converter comprises said first and second nodes.

9. The traveling wave tube system as recited in claim 1 wherein more than one collector electrode operates at a potential below the potential of said cathode.

10. A method of operating a traveling wave tube incorporating an electron gun having a cathode having a potential and further incorporating a collector with a plurality of collector electrodes, each collector electrode having a respective potential applied thereto, said plurality of collector electrodes for collecting electrons from said beam of electrons, comprising:

a) locating one of said plurality of collector electrodes within said traveling wave tube so as to collect relatively high energy electron, whereby the potential of said one of said plurality of collectors is less than the electrical potential of the cathode;

b) collecting said relatively high energy electrons with said one of said plurality of collector so as to generate a collector current; and c) operatively coupling said collector current to an electrical load d) converting said collector current to a first alternating current signal.

11. The method of operating a traveling wave tube as recited in claim 10 further comprising the operation of converting said first alternating current signal into a second alternating current signal.

12. The method of operating a traveling wave tube as recited in claim 11 further comprising the operation of applying said second alternating current signal to an electrical load.

13. The method of operating a traveling wave tube as recited in claim 10, further comprising the operation of converting said first alternating current signal into an alternating magnetic field within a core of a transformer.

14. The method of operating a traveling wave tube as recited in claim 13 wherein said said step of converting said first alternating current signal into an alternating magnetic field within a core of a transformer further comprises the step of said transformer supplying power to the traveling wave tube.

15. The method of operating a traveling wave tube as recited in claim 10 further comprising the operation of applying said collector current to an electrical load.

* * * * *